US006577489B1

(12) United States Patent
Blim

(10) Patent No.: US 6,577,489 B1
(45) Date of Patent: Jun. 10, 2003

(54) DEVICE FOR ELECTROSTATIC CHARGING OF A MULTILAYER PAPER WEB

(75) Inventor: Werner Blim, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/403,001

(22) PCT Filed: Apr. 16, 1998

(86) PCT No.: PCT/DE98/01063

§ 371 (c)(1),
(2), (4) Date: Oct. 15, 1999

(87) PCT Pub. No.: WO98/47802

PCT Pub. Date: Oct. 29, 1998

(30) Foreign Application Priority Data

Apr. 18, 1997 (DE) ..... 197 16 325

(51) Int. Cl.[7] ..... H01G 3/00; H01H 3/00; H02H 3/00; H05F 3/00

(52) U.S. Cl. ..... 361/225

(58) Field of Search ..... 101/170, 426, 101/153; 270/47; 361/233, 225, 230; 399/303, 315, 3

(56) References Cited

U.S. PATENT DOCUMENTS

| | | | | |
|---|---|---|---|---|
| 3,625,146 A | | 12/1971 | Hutchison | |
| 4,129,469 A | | 12/1978 | Deverell et al. | |
| 4,462,528 A | * | 7/1984 | Kisler | 226/120 |
| 4,539,908 A | * | 9/1985 | Spengler | 101/426 |
| 4,909,147 A | * | 3/1990 | George et al. | 101/170 |
| 4,978,118 A | * | 12/1990 | Kasahara | 271/275 |
| 5,064,180 A | * | 11/1991 | Wingate | 270/47 |
| 5,322,011 A | * | 6/1994 | Hahne et al. | 101/153 |

FOREIGN PATENT DOCUMENTS

| | | | | |
|---|---|---|---|---|
| DE | 2754179 A1 | | 8/1979 | |
| DE | 3117419 A1 | | 4/1982 | |
| DE | 2754179 C1 | | 9/1984 | |
| DE | 3117419 C2 | | 10/1986 | |
| DE | 659035 A5 | | 12/1986 | |
| DE | 4204871 A1 | | 8/1993 | |
| DE | WO 98/43904 | | 10/1998 | |
| DE | WO 98/43905 | | 10/1998 | |
| EP | 0230305 A2 | | 7/1987 | |
| EP | 0378350 A2 | | 7/1990 | |
| GB | 2077235 A | * | 5/1981 | B65H/5/30 |
| JP | 63-314889 | | 12/1988 | |
| JP | 2-185498 | | 7/1990 | |

* cited by examiner

*Primary Examiner*—Brian Sircus
*Assistant Examiner*—Z. Kitov
(74) *Attorney, Agent, or Firm*—Jones, Tullar & Cooper, P.C.

(57) ABSTRACT

A multiple layer paper web is provided with an electrostatic charge for the purpose of adhering the multiple webs to each other. A pair of oppositely charged rollers contact the surface of the multiple layer printing aper web and impart the charge to the web. The pair of oppositely charged rollers are positioned directly before a cylinder folding group of a web-fed rotary printing press.

14 Claims, 4 Drawing Sheets

DEVICE FOR ELECTROSTATIC CHARGING OF A MULTILAYER PAPER WEB

FIELD OF THE INVENTION

The present invention relates to a device for electrostatically charging a multilayer ribbon or paper web train.

DESCRIPTION OF THE PRIOR ART

It is generally known and described in EP 0 230 305 A2 that in rotogravure printing the incoming material webs or respectively paper web train or ribbons, are made to adhere to each other electrostatically, which adheres is called ribbon adherence. The stability of the material webs or paper web trains is increased by means of this electrostatic interlocking, so that the danger of a formation of corners of the printed products in the folding apparatus is reduced. Electrodes, which are arranged at both sides of the material webs and at a distance from the material webs are provided for applying the electrostatic charge.

In connection with this electrostatic charge, its low effectiveness on the paper web train or ribbon is disadvantageous, so that it became necessary to arrange additional devices, for example electrostatically charged guide devices, as disclosed in EP 0 230 305 A2 in order to reduce the effects of the so-called whip action, which leads to the formation of corners.

DE 31 17 419 C2 describes a method for the electrostatic charging of a multilayer paper web train ribbon. Here, the ribbon is charged by means of contactless acting electrodes after the webs have been brought together to form a ribbon downstream of a pair of compression rollers.

DE 27 54 179 C2 discloses a method for the electrostatic charging of a multilayer ribbon, wherein the edge areas of each layer are individually charged by means of rollers.

EP 0378350 A2 discloses a transport device for paper sheets in a plotter. This transport device has transport rollers for electrostatically charging a paper sheet and a plastic sheet.

U.S. Pat. No. 4,462,528 A describes a device for holding a web. This device has brushes, by means of which the web is held electrostatically.

SUMMARY OF THE INVENTION

The present object of the invention is based on providing a device for the electrostatic charging of a multilayer ribbon.

In accordance with the invention, this object is attained by the use of two rollers which press the ribbon or paper web train together and which also act as charging electrodes. Alternatively, the paper web train or ribbon can be electrostatically charged by oppositely polarized charge electrodes in the form of electrically conductive brushes which touch the paper web train or ribbon.

The advantages which can be achieved by means of the invention lie, in particular, in that charging of the paper web train ribbon takes place in a manner which is so lasting, that further devices for preventing, or reducing the formation of corners can be omitted. For example, an already provided pair of drawing rollers, which is required for the operation of the folding apparatus and has been modified in its design for the purpose of transmitting a voltage, is used as the device for charging the ribbon.

The strength of the voltage required for charging the ribbon is reduced in comparison with the voltage required by the prior art.

BRIEF DESCRIPTION OF THE DRAWINGS

Preferred embodiments of present the invention are represented in the drawings and will be described in greater detail in what follows.

Shown are in.

DESCRIPTION OF THE PREFERRED EMBODIMENTS

Figure 1:
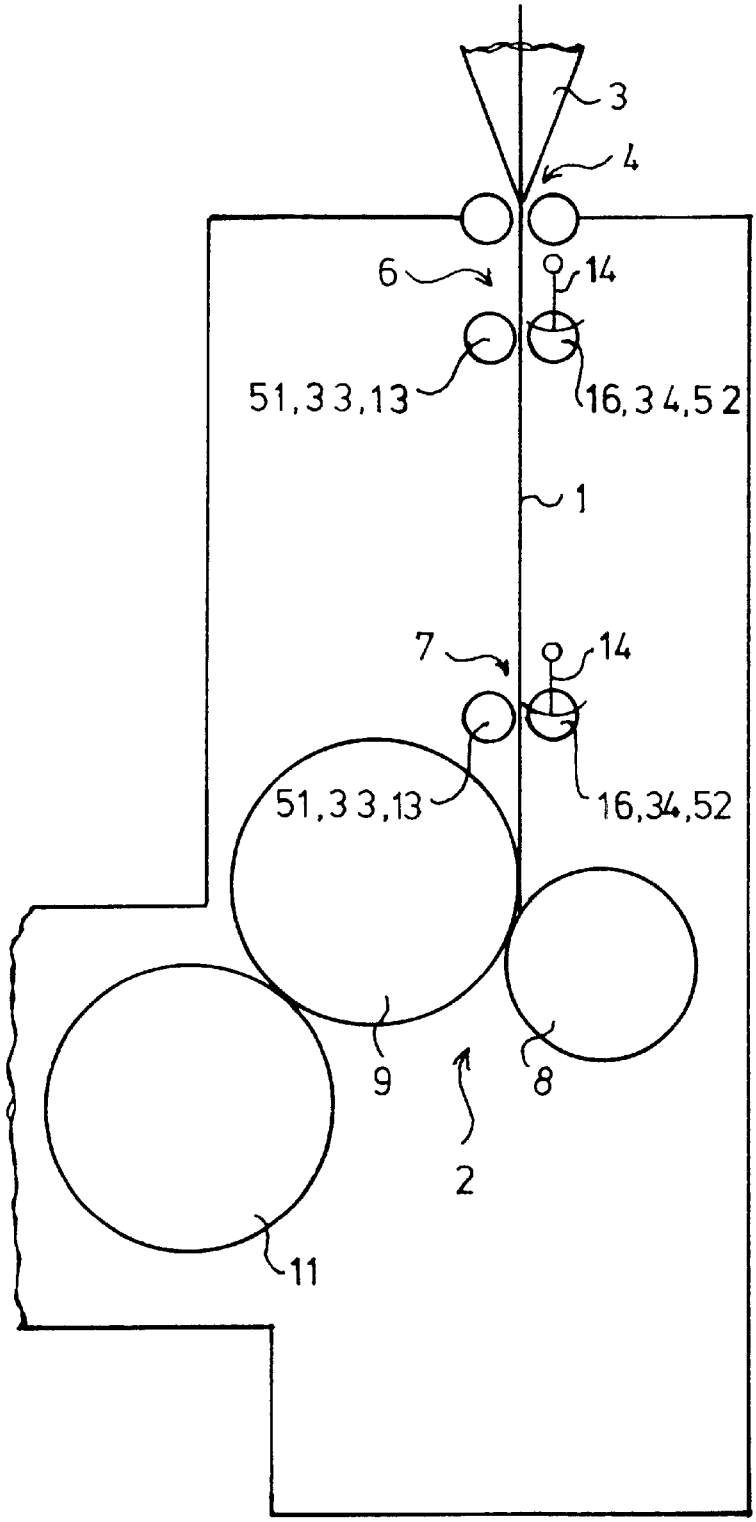
FIG. 1, a schematic representation of a longitudinal folding device, as well as the ribbon entry into a cylinder folding group.

A longitudinal folding device 3 with a pair of funnel folding rollers 4, as well as two pairs of rollers, for example, drawing roller pairs 6, 7, are arranged ahead of the entry for a multilayer ribbon 1, formed of for example, a plurality of paper webs, into a cylinder folding group 2, for example, of a folding apparatus of a rotary printing press. This structure is depicted most clearly FIG. 1.

The cylinder folding group 2 has a cutter cylinder 8 and a collection cylinder 9, which operates against the cutter cylinder 8 and, in turn, works together with a folding jaw cylinder 11. The printed products, which have been transversely folded in the cylinder folding group 2, are supplied to a further processing station by means of a conveying device, for example a belt conveyor device which is not specifically shown in the drawings.

Figure 2:
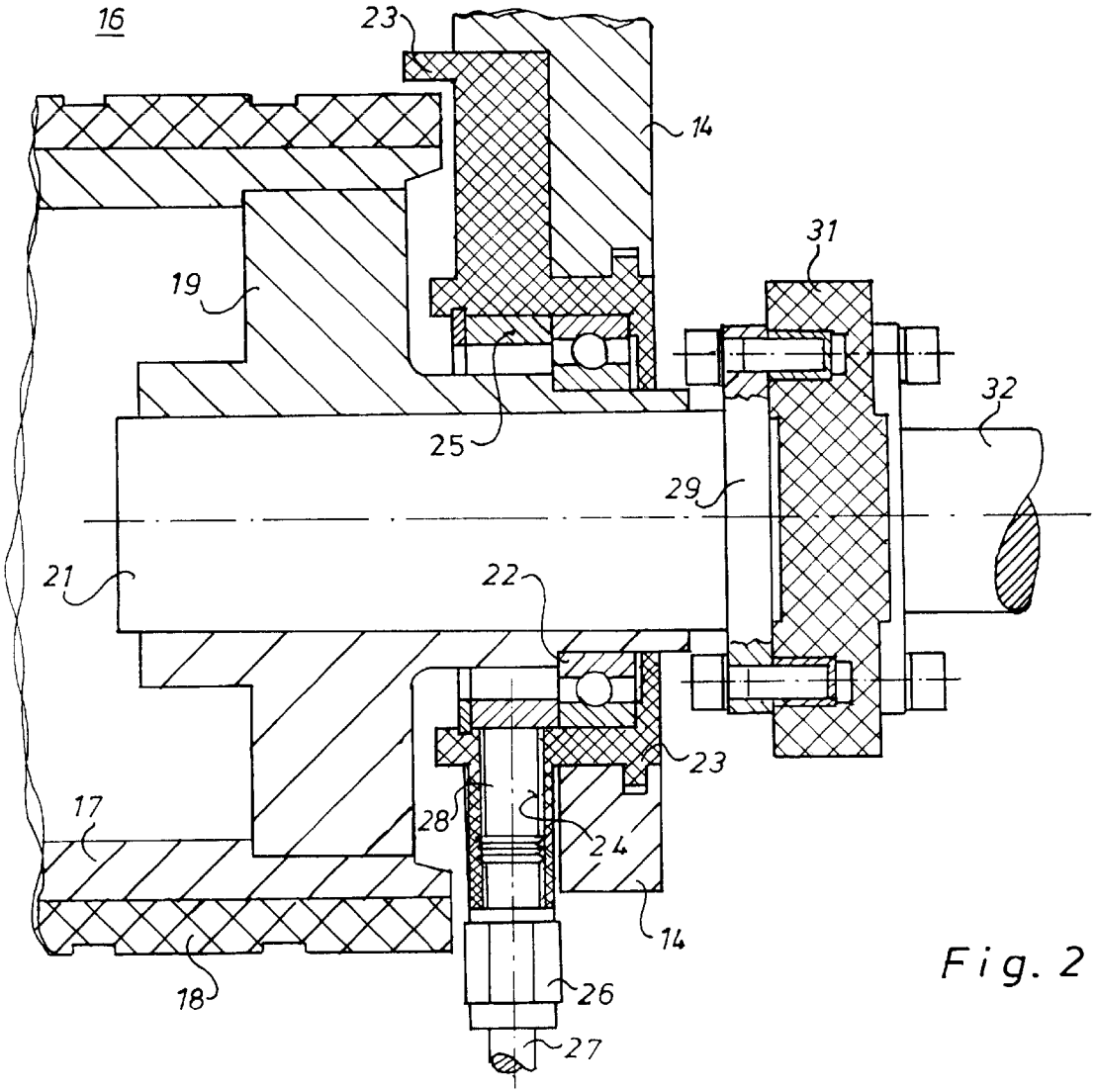
FIG. 2, a longitudinal section through one roller of a pair of rollers of the present invention in accordance with FIG. 1.

The second pair of drawing rollers 7, arranged directly in front of the entry into the cylinder folding group 2, consists of a first roller 13, seated fixed in a lateral frame, and a second roller 16, which is seated on a pivot arm or bearing element 14 as seen in FIG. 2. This second roller 16 can be placed against the first roller 13 seated fixed in the lateral frame, with both rollers 13 and 16 of the second pair of drawing rollers 7 constituting the charging electrodes. The running paper web trainer ribbon 1 is conducted between the two rollers 13, 16.

In accordance with a first preferred embodiment as seen in FIG. 2 both rollers 13, 16 consist of a cylinder- or hollow cylinder-shaped roller body, a metal body 17, which has a shell 18 of a resilient covering of reduced conductivity, for example rubber of a hardness of approximately 85° Shore. The metal body 17 is connected, fixed against relative rotation, at both ends by means of hubs 19—only one end being represented in FIG. 2—with the shaft journal 21.

The hubs 19 are fastened, electrically insulated, by means of ball bearings 22 in the bearing element 14. An insulation which consists, for example, of respective bushings 23 of insulating material, for example a resin-bonded fabric, arranged between the pivot arm, or respectively the bearing element 14, and the ball bearing 22, which has a radial bore 24 for receiving a cable feed 26. The cable feed 26 receives a feed line, for example a cable 27 which, for the purpose of transferring energy via an intermediate ring 25, is pressed by means of a spring-loaded contact element 28 against the ball bearing 22.

At its end remote from the roller 16 the shaft journal 21 is connected, fixed against relative rotation, with an annular flange 29, which, in turn, is in connection, fixed against relative rotation, via a piece 31 of insulating material with a driveshaft 32.

Each one of the rollers 13, 16 of the second drawing roller pair 13 can be separately driven. Moreover, the first roller 13 of the second pair 7 of drawing rollers is connected with a negative pole of a d.c. source, not represented, of approximately 5 kilovolts, for example a high tension d.c. generator, and the second roller 16 of the second pair 7 of drawing rollers is connected with a positive pole of the d.c. source. The polarity can also be reversed.

The paper web train or ribbon 1 preferably consists of paper webs, which are weakly mineralized and highly resistive.

It is also possible to drive only one roller 13 or 16 of the pair of rollers 13, 16, or neither of the rollers of the pair of rollers 13, 16.

Figure 3:
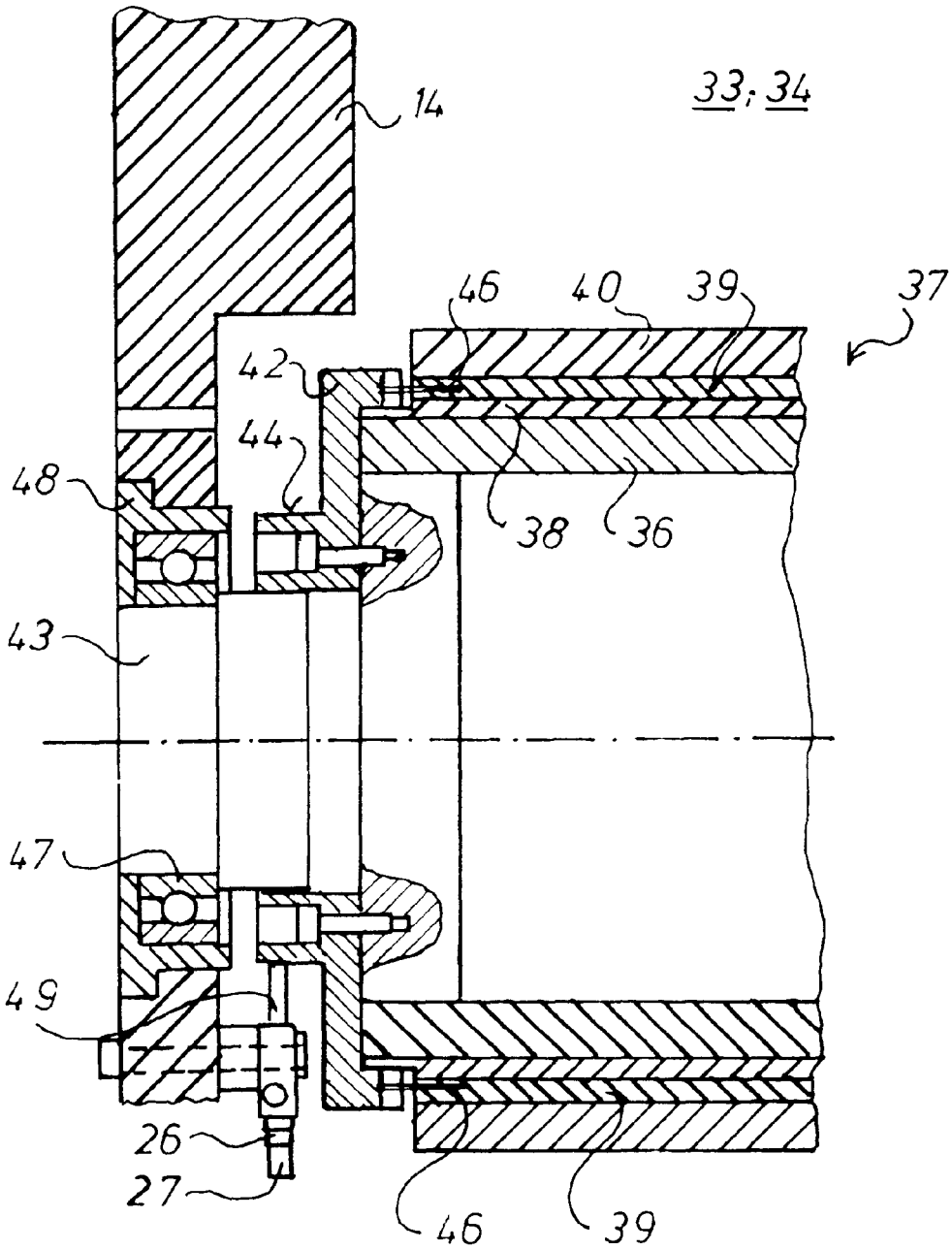
FIG. 3, a representation analogous to FIG. 2, but with a second preferred embodiment; and in FIG. 4, a representation analogous to FIG. 2, but with a third preferred embodiment.

In accordance with a second preferred embodiment as seen in FIG. 3, both charge electrodes, which are designed as rollers 33, 34, also consist of a cylinder- or hollow cylinder-shaped metal body 36, which has a multi-layer shell 37 comprised of with a lower, electrically insulating layer 38, a center layer 39 which conducts electricity well, and an outer layer 40, which is of only limited electrical conductivity.

At an end of each of the respective rollers 33, 34 a metallic contact ring 42 is arranged on a roller end face. An interior diameter of contacting 42 is in connection with the shaft journal 43, and a peripheral surface of contact ring 42 is in an electrically conducting connection with the electrically conducting center layer 39 of the roller shell 37. This can be achieved, for example, in that the contact ring 42 has a shell-like contact surface 44 on its periphery, which extends concentrically in respect to the metal body 36 and which in turn supports contact tips 46, which are arranged on the end face of contacting 42 in a ring shape, are spaced apart from each other and are connected with the material of the center layer 39 of shell 37 which center layer 39 conducts electricity well.

The shaft journals 43—only one of which is represented—are seated in the bearing element 14 in bearings 47, which are also surrounded by an insulating material 48.

A wiper element 49, which is fixed on the bearing element 14 and which is insulated against it, is connected with the contact surface 44 of the contacting 42, and is pressed by means of a spring force against the contact surface 44. As in the first preferred embodiment, the wiper element 49 is connected with a cable feed 26 4 and a cable 27.

Figure 4:
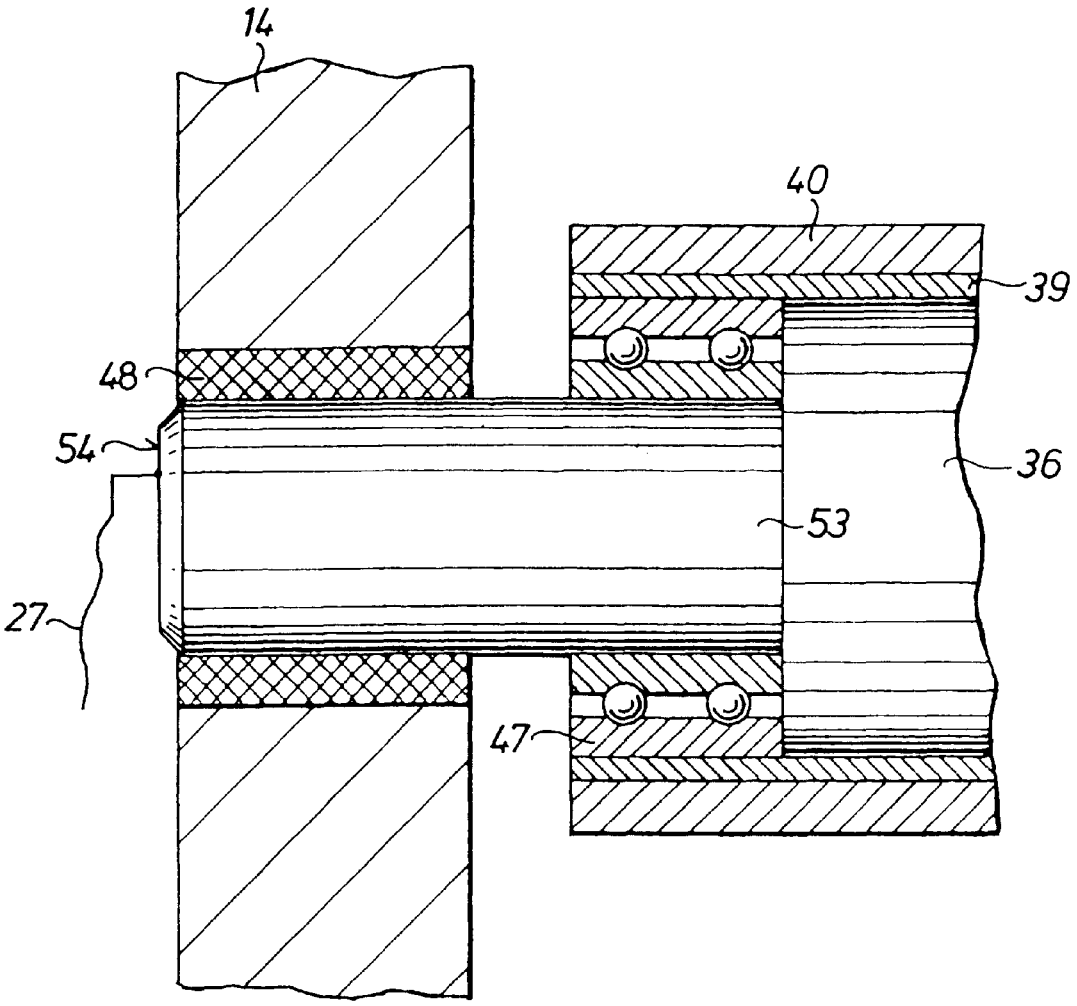

In accordance with a third preferred embodiment, as seen in FIG. 4, the rollers 51, 52 which act as charge electrodes, respectively each consist of a stationary shaft journal 53, fixed on the frame 14 in an insulating material 48 and having a roller body or metal body 36. The metal body 36 is provided with an electrical high conductivity layer 39, for example a steel shell, above which an outer layer 40 of limited electrical conductivity is arranged. One bearing 47 is arranged on both sides or ends of each of the rollers 51, 52 between the shaft journal 53 and the steel shell 39.

The supply of electrical energy to the rollers 51, 52 takes By place via a cable 27, which is in electrically conducting contact with the shaft journal 53, for example with an exterior surface 54 of the shaft journal 53.

It would, of course, also be possible to arrange the shell 39, 40 fixedly on the metal body 36 and to seat the journals 53, electrically insulated and rotatably in the bearing element 14 fixed in place in the lateral frame. In this case the cable 27 would have to be connected by means of a collector ring with the exterior 54 of the shaft journal 53.

In accordance with a fourth preferred embodiment which is, not specifically represented, the transfer of electrical energy to the ribbon 1 can also take place by means of conducting brushes, for example carbon brushes, arranged on both sides of the material webs of the ribbon 1.

It is furthermore possible to design the first and second rollers 13, 16, 33, 34, 51, 52 of the second drawing roller pair 7 also in the form of so-called sandwich rollers.

Such sandwich rollers consist, for example, of a rotatably seated shaft, which receives a number of disks, which are arranged, fixed against relative rotation, on the shaft in the radial direction. Here, a disk made of metal, for example steel, alternates with an adjoining disk, which consists of a metal body having an electrically well conducting layer 39, and above it an outer layer 40 of limited electrical conductivity such as shown in FIGS. 3 and 4. Electrical energy is introduced via the shaft journal.

Such a sandwich roller can be placed against a ribbon 1 as an individual roller, or also in opposing pairs, for example as a pair of drawing rollers.

When used in pairs, both sandwich rollers should be arranged in such a way that a metal disk of the first roller is placed opposite a layered disk of the second roller, and vice versa. Each roller of the pair of rollers has a different polarity.

While preferred embodiments of a method and a for electrostatically charging a multilayer train or paper web ribbon in accordance with the present invention have been set forth fully and completely hereinabove, it will be apparent to one of skill in the art that a number of changes in, for example, the source of drive power for the rollers, the specific type of printing press and folding group used and the like could be made without departing from the true spirit and scope of the present invention which is accordingly to be limited only by the following claims.

What is claimed is:

1. A device for the electrostatic charging of a multi-layered paper web comprising:

at least a first pair of cooperating rollers, said pair of cooperating rollers defining a passage for said multi-layered paper web and pressing said multi-layered paper web together during passage of said multi-layered paper web between said at least first pair of cooperating rollers;

means for applying a first electrical charge to a first one of said pair of cooperating rollers and a second electrical charge, opposite from said first electrical charge to a second one of said pair of cooperating rollers, said pair of cooperating rollers applying an electrostatic charge to said multi-layered paper web during passage of said multi-layer paper web between said pair of cooperating rollers, said electrostatic charge adhering layers of said multi-layer paper web together; and means to separately drive each of said rollers in said pair of cooperating rollers.

2. A device for the electrostatic charging of a multi-layered paper web comprising:

at least a first pair of cooperating rollers, said pair of cooperating rollers defining a passage for said multi-layered paper web and pressing said multi-layered paper web together during passage of said multi-layered paper web between said at least first pair of cooperating rollers, said pair of cooperating rollers being drawing rollers; and means for applying a first electrical charge to a first one of said pair of cooperating rollers and a second electrical charge, opposite from said first electrical charge to a second one of said pair of cooperating rollers, said pair of cooperating rollers applying an electrostatic charge to said multi-layered paper web during passage of said multi-layer paper web between said pair of cooperating rollers, said electrostatic charge adhering layers of said multi-layer paper web together.

3. The device of claim 1 wherein each of said rollers in said pair of cooperating rollers includes a metal roller body and an outer shell of a limited electrical conductivity coating supported on said metal roller body.

4. The device of claim 1 wherein each of said rollers in said pair of cooperating rollers includes a metal roller body and a roller shell supported on said metal roller body, said roller shell including an inner electrically insulating layer, an electrically highly conductive center layer and an outer layer of limited electrical conductivity.

5. The device of claim 1 wherein each of said rollers in said pair of cooperating rollers includes a metal roller body including journals and further including bearing elements supporting said journals, an electrically highly conductive intermediate layer on said metal roller body, and an exterior limited electrically conductive layer on said electrically highly conductive intermediate layer.

6. The device of claim 5 wherein said journals are electrically insulated from, and are fixed in place in said bearing elements and further wherein said electrically conductive layers of said rollers are rotatably supported on said metal roller body.

7. The device of claim 5 wherein said journals are electrically insulated from, and are fixed in place in said bearing elements and further wherein said electrically conductive layers of said rollers are fixed in place on said metal roller body.

8. The device of claim 1 further including a support journal for each of said rollers in said pair of cooperating rollers and an electrical feed line for transmitting electrical energy to each of said journals of each of said rollers.

9. The device of claim 8 wherein each of said support journals has an outside surface and further wherein said electrical feed line to each of said support journals contact said outside surface of each said support journal.

10. The device of claim 4 further including a support journal for each of said rollers in said pair of cooperating rollers, bearing elements receiving each of said support journals, an electrical feed line for transmitting electrical energy and a wiper body in contact with said electrical feed line, said wiper body being fixed in place on said bearing element for each said roller and contacting said electrically highly conductive center layer, said support journals being supported electrically insulated in each of said bearing elements.

11. The device of claim 1 wherein each of said rollers in said pair of cooperating rollers is a sandwich roller.

12. The device of claim 1 wherein said first roller of said pair of cooperating rollers is connected with a negative pole of a high tension d.c. source and further wherein said second roller of said pair of cooperating rollers is connected with a positive pole of said high tension d.c. source.

13. The device of claim 1 wherein said pair of cooperating rollers apply said electrostatic charge to said multi-layer paper web over an entire width of said multi-layer paper web.

14. The device of claim 1 wherein said pair of cooperating rollers contact said multi-layer paper web after a point of assembly of said multi-layer paper web, and contact outside surfaces of said multi-layer paper web.

* * * * *